US009169037B2

(12) United States Patent
Pinkstone

(10) Patent No.: US 9,169,037 B2
(45) Date of Patent: Oct. 27, 2015

(54) CARTON WITH RECLOSEABLE FEATURES

(71) Applicant: Graphic Packaging International, Inc., Atlanta, GA (US)

(72) Inventor: Felicia A. Pinkstone, Aston, PA (US)

(73) Assignee: Graphic Packaging International, Inc., Atlanta, GA (US)

( * ) Notice: Subject to any disclaimer, the term of this patent is extended or adjusted under 35 U.S.C. 154(b) by 0 days.

(21) Appl. No.: 14/268,163

(22) Filed: May 2, 2014

(65) Prior Publication Data

US 2014/0326743 A1 Nov. 6, 2014

Related U.S. Application Data

(60) Provisional application No. 61/854,854, filed on May 3, 2013.

(51) Int. Cl.
*B65D 5/54* (2006.01)
*B65D 5/10* (2006.01)

(52) U.S. Cl.
CPC ..... *B65D 5/10* (2013.01)

(58) Field of Classification Search
CPC ..... B65D 5/5415
USPC ..... 220/826, 833, 839; 229/150, 155, 156; 493/136, 162, 84
See application file for complete search history.

(56) References Cited

U.S. PATENT DOCUMENTS

| | | | | |
|---|---|---|---|---|
| 5,125,565 | A * | 6/1992 | Rogers | 229/115 |
| 5,292,058 | A * | 3/1994 | Zoss et al. | 229/123 |
| 7,021,525 | B2 * | 4/2006 | Jouppi et al. | 229/155 |
| 2004/0182916 | A1 * | 9/2004 | Roseth | 229/155 |
| 2006/0255105 | A1 * | 11/2006 | Sweet | 229/101.2 |
| 2007/0095881 | A1 * | 5/2007 | Manaige | 229/101.2 |

FOREIGN PATENT DOCUMENTS

| | | |
|---|---|---|
| JP | 2004-123101 A | 4/2004 |
| JP | 2009-073536 A | 4/2009 |

OTHER PUBLICATIONS

International Search Report and Written Opinion for PCT/US2014/036502 dated Aug. 27, 2014.

* cited by examiner

*Primary Examiner* — Steven A. Reynolds
*Assistant Examiner* — King M Chu
(74) *Attorney, Agent, or Firm* — Womble Carlyle Sandridge & Rice, LLP

(57) ABSTRACT

A carton for containing a product. The carton comprises a plurality of panels that extends at least partially around an interior of the carton. The plurality of panels comprises a first end panel, a first side panel, a second end panel, and a second side panel. A plurality of end flaps is respectively foldably connected to a respective panel of the plurality of panels for closing an end of the carton. The plurality of end flaps comprises a first end flap foldably connected to the first side panel and a second end flap foldably connected to second side panel. The first end flap and the second end flap have cooperating features for interlocking engagement of the end flaps in a closed configuration of the carton.

21 Claims, 14 Drawing Sheets

CARTON WITH RECLOSEABLE FEATURES

CROSS-REFERENCE TO RELATED APPLICATION

This application claims the benefit of U.S. Provisional Patent Application No. 61/854,854, filed May 3, 2013.

INCORPORATION BY REFERENCE

The disclosure of U.S. Provisional Patent Application No. 61/854,854, which was filed on May 3, 2013, is hereby incorporated by reference for all purposes as if presented herein in its entirety.

BACKGROUND OF THE DISCLOSURE

The present disclosure generally relates to packages or cartons for holding and dispensing products, such as food products. More specifically, the present disclosure relates to cartons with reclosable features.

SUMMARY OF THE DISCLOSURE

In general, one aspect of the disclosure is generally directed to a carton for containing a product. The carton comprises a plurality of panels that extends at least partially around an interior of the carton. The plurality of panels comprises a first end panel, a first side panel, a second end panel, and a second side panel. A plurality of end flaps is respectively foldably connected to a respective panel of the plurality of panels for closing an end of the carton. The plurality of end flaps comprises a first end flap foldably connected to the first side panel and a second end flap foldably connected to second side panel. The first end flap and the second end flap have cooperating features for interlocking engagement of the end flaps in a closed configuration of the carton.

In another aspect, the disclosure is generally directed to a blank for forming a carton for containing a product. The blank comprises a plurality of panels comprising a first end panel, a first side panel, a second end panel, and a second side panel. A plurality of end flaps are respectively foldably connected to a respective panel of the plurality of panels for closing an end of the carton formed from the blank. The plurality of end flaps comprises a first end flap foldably connected to the first side panel and a second end flap foldably connected to second side panel. The first end flap and the second end flap have cooperating features for interlocking engagement of the end flaps in a closed configuration of the carton formed from the blank.

In another aspect, the disclosure is generally directed to a method of forming a carton. The method comprising obtaining a blank comprising a plurality of panels comprising a first end panel, a first side panel, a second end panel, and a second side panel. The blank comprises a plurality of end flaps respectively foldably connected to a respective panel of the plurality of panels. The plurality of end flaps comprises a first end flap foldably connected to the first side panel and a second end flap foldably connected to second side panel. The first end flap and the second end flap have cooperating features for opening and closing the end of the carton formed from the blank. The method comprising forming an interior of the carton at least partially defined by the plurality of panels, positioning the plurality of end flaps to close an end of the interior wherein the first end flap and the second end flap are at least partially overlapped and are secured, opening the end of the carton by separating the first end flap and the second end flap, and closing the end of the carton by interlockingly engaging the cooperating features of the first end flap and the second end flap.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

Cartons or packages according to the present disclosure can accommodate articles of numerous different shapes. For the purpose of illustration and not for the purpose of limiting the scope of the disclosure, the following detailed description describes articles at least partially disposed within the carton embodiments. In one embodiment, the articles held in the carton can be food products, but the articles could be other nonfood products without departing from the disclosure. In this specification, the terms "lower," "bottom," "upper", "top", "front", and "back" indicate orientations determined in relation to fully erected cartons.

Figure 1:
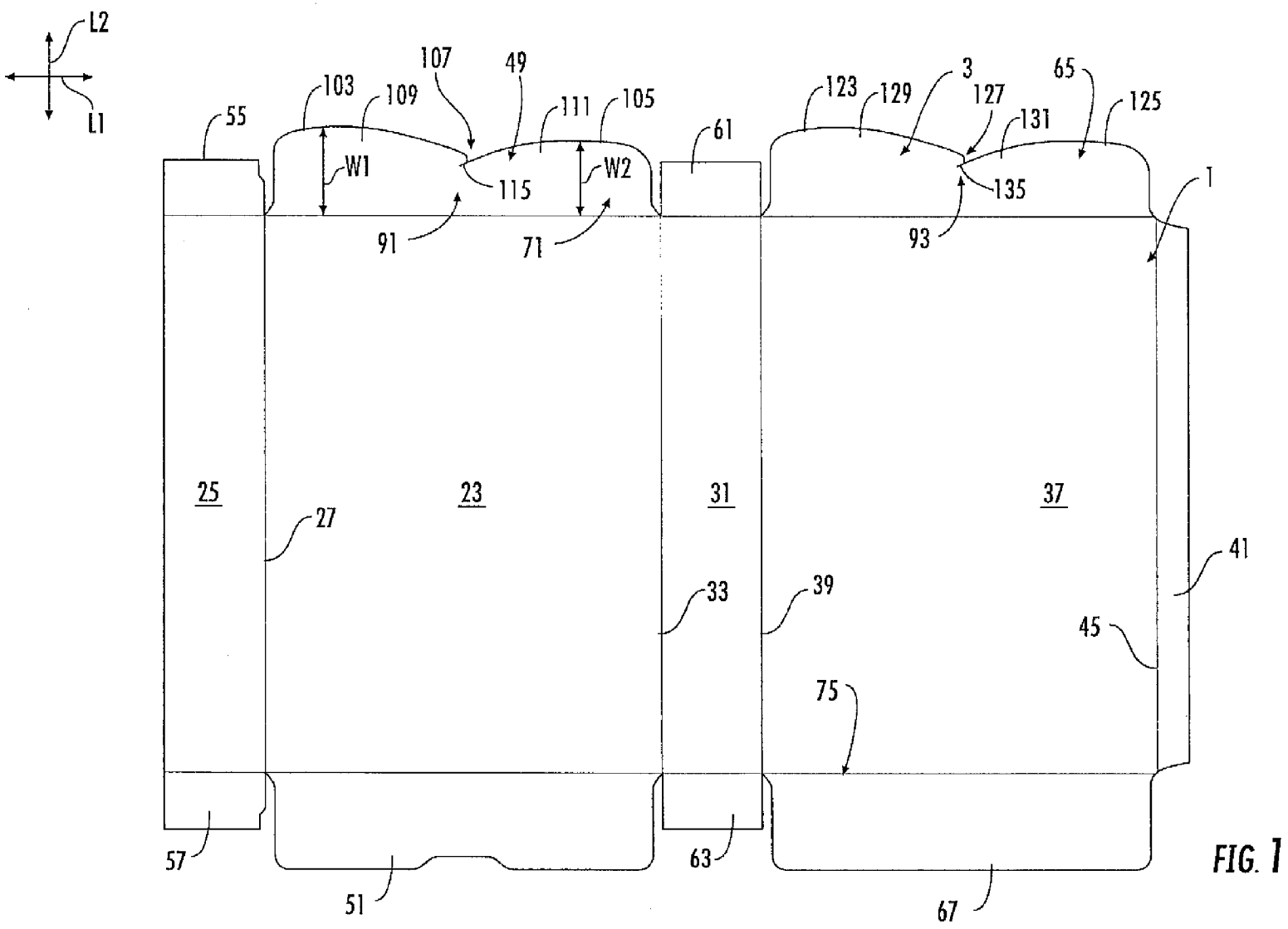
FIG. 1 is an exterior plan view of a blank used to form a carton in accordance with a first embodiment of the disclosure.
Figure 4:
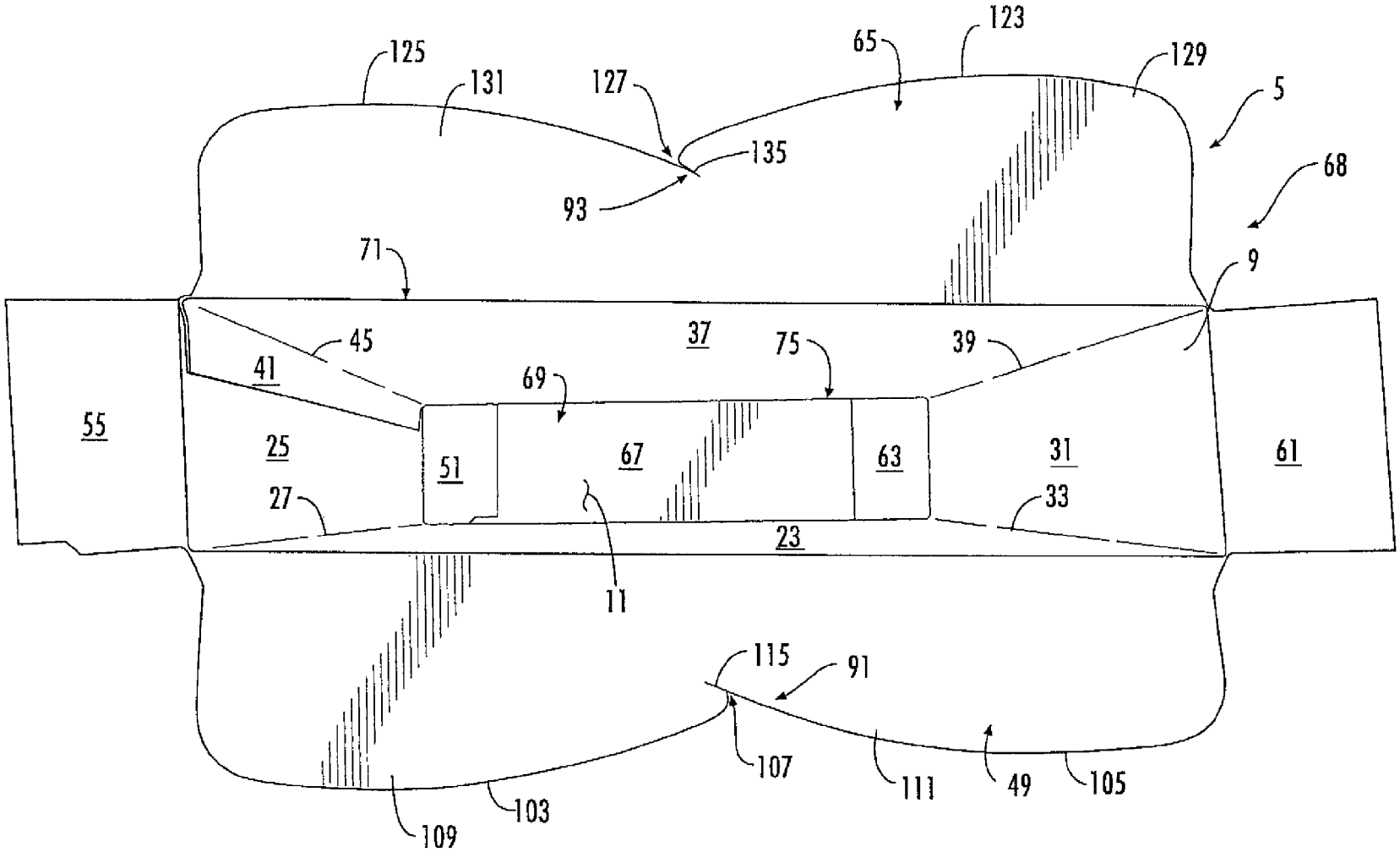
FIG. 4 is a view showing the end of the carton of FIG. 3 in an opened configuration.

FIG. 1 is a plan view of an exterior surface 1 of a blank 3 used to form a carton 5 (FIG. 2) of a first embodiment of the disclosure. The carton 5 may include a liner, bag, or other construct that is in contact with an interior surface 9 of the carton 5 (FIG. 4). The carton 5 can be configured to hold articles (not shown) such as a plurality of food products (e.g., candy, crackers, popcorn, breakfast cereal, or any other food product) or nonfood products (grass seed, fertilizer, detergent, or any other nonfood product), or any other suitable article or product within an interior space 11 (FIG. 5) of the carton 5. The carton 5 can include various dispensing features and various opening/closing features without departing from the disclosure.

The blank 3 has a longitudinal axis L1 extending generally in the direction of the length of the blank and a lateral axis L2 extending generally in the direction of the width of the blank. The blank 3 includes a first side panel 23 foldably connected to a first end panel 25 at a lateral fold line 27. A second end panel 31 is foldably connected to the first side panel 23 at a lateral fold line 33. A second side panel 37 is foldably connected to the second end panel 31 at a lateral fold line 39. An attachment flap 41 is foldably connected to the second side panel 37 at a lateral fold line 45. Alternatively, the attachment flap 41 could be foldably connected to the first side panel 25. In one or more embodiments of the assembled carton 5, the first side panel 23 can be located at the front side of the carton and the second side panel 37 can be located at the back side of the carton such as when the carton comprises a cereal box or other container having a front and back sides that display information to consumers. Alternatively, the first side panel 23 could be a back panel and the second side panel 37 could be a front panel without departing from the disclosure.

Figure 2:
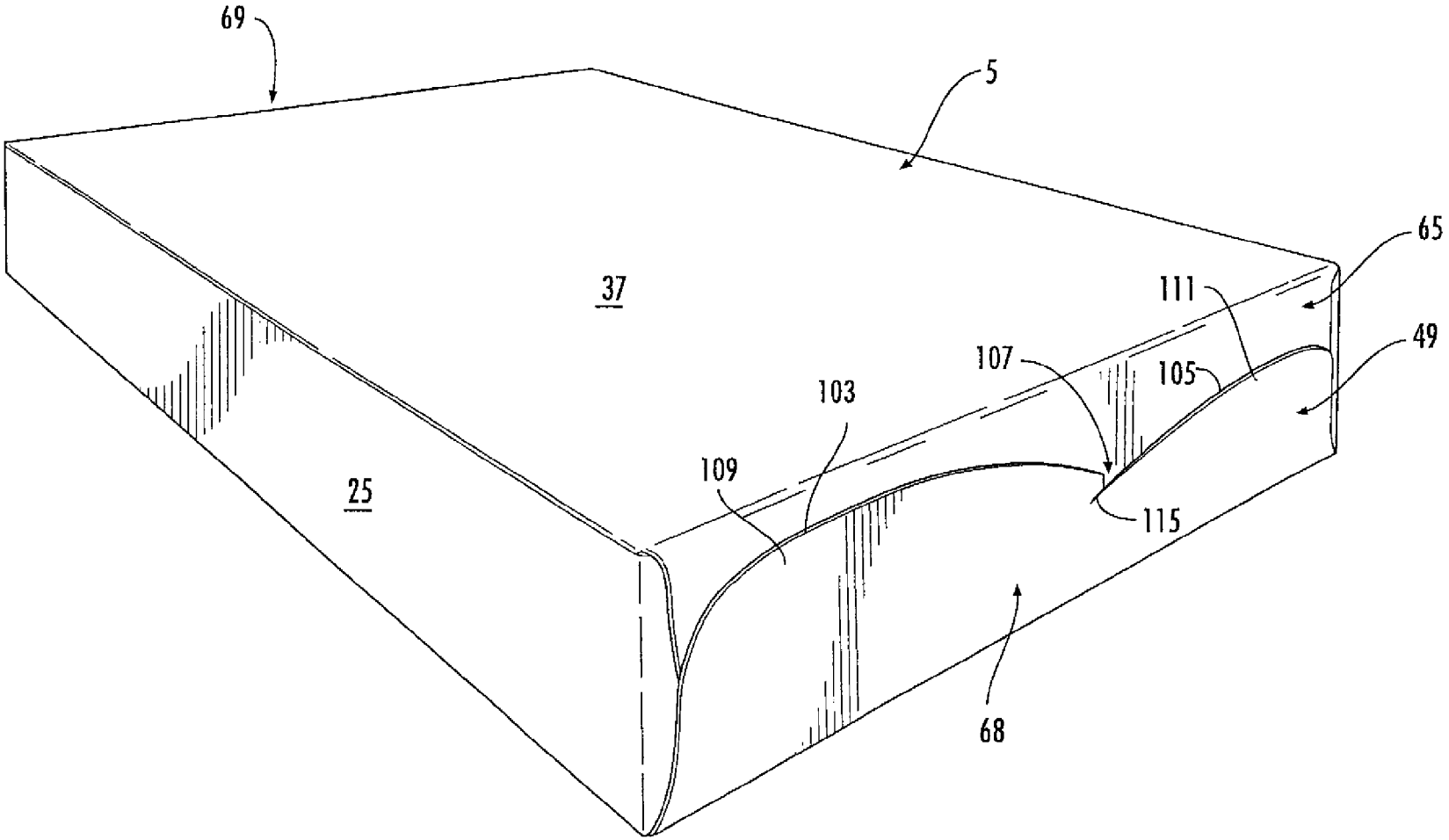
FIG. 2 is a perspective view of the carton of the first embodiment.

In the illustrated embodiment, two end flaps 49, 51 are foldably connected to opposite ends of the first side panel 23. Two end flaps 55, 57 are foldably connected to opposite ends of the first end panel 25. Two end flaps 61, 63 are foldably connected to opposite ends of the second end panel 31. Two end flaps 65, 67 are foldably connected to opposite ends of the second side panel 37. When the carton 5 is erected, the end flaps 49, 55, 61, 65 close a first (e.g., top) end 68 of the carton, and the end flaps 51, 57, 63, 67 close a second (e.g., bottom) end 69 of the carton (FIG. 2). In accordance with an alternative embodiment of the present disclosure, different panel and flap arrangements can be used for closing the carton 5.

The end flaps 49, 55, 61, 65 of the first end 68 extend along a first marginal area of the blank 3, and are foldably connected at a first longitudinal fold line 71 that extends along the length of the blank. The end flaps 51, 57, 63, 67 of the second end 69 extend along a second marginal area of the blank 3, and are foldably connected at a second longitudinal fold line 75 that extends along the length of the blank. The longitudinal fold lines 71, 75 may be, for example, substantially straight, or offset at one or more locations to account for blank thickness or for other factors. The end flaps 49, 55, 65, 51, 57, 61, 63, 67 can be alternatively shaped, arranged, positioned, and/or omitted without departing from the disclosure.

As shown in FIG. 1, the end flaps 49, 65 each have cooperating features 91, 93 that facilitate opening and closing the top end 68 of the carton 5. In one embodiment, the features 91 of the first end flap 49 include a first curved edge 103, a second curved edge 105 that converge at approximately the middle of the end flap 49. A notch 107 is formed at the convergence of the first curved edge 103 and the second curved edge 105. In one embodiment, the notch 107 separates the end flap 49 into a first flap portion 109 on one side of the notch, and a second flap portion 111 on the other side of the notch. As shown in FIG. 1, the notch 107 comprises a cut 115 that extends from the second curved edge 105 into the end flap 49. In one embodiment, the first flap portion 109 has a maximum width W1 measured from the fold line 71 that is greater than a maximum width W2 of the second flap portion 111 measured from the fold line 71. The end flap 49 could be otherwise shaped, arranged, and/or configured without departing from the disclosure.

In the embodiment of FIG. 1, the second end flap 65 is shaped identical to first end flap 49 such that the cooperating features 93 of the second end flap are identical to the cooperating features 91 of the first end flap. The second end flap 65 has curved edges 123, 125, a notch 127 at the convergence of the curved edges, a first flap portion 129, as second flap portion 131, and a cut 135. The first end flap portion 129 has a maximum width corresponding to W1 and the second end flap portion 131 has a maximum width corresponding to W2. The second end flap 65 could be otherwise shaped, arranged, and/or configured without departing from the disclosure.

Figure 3:
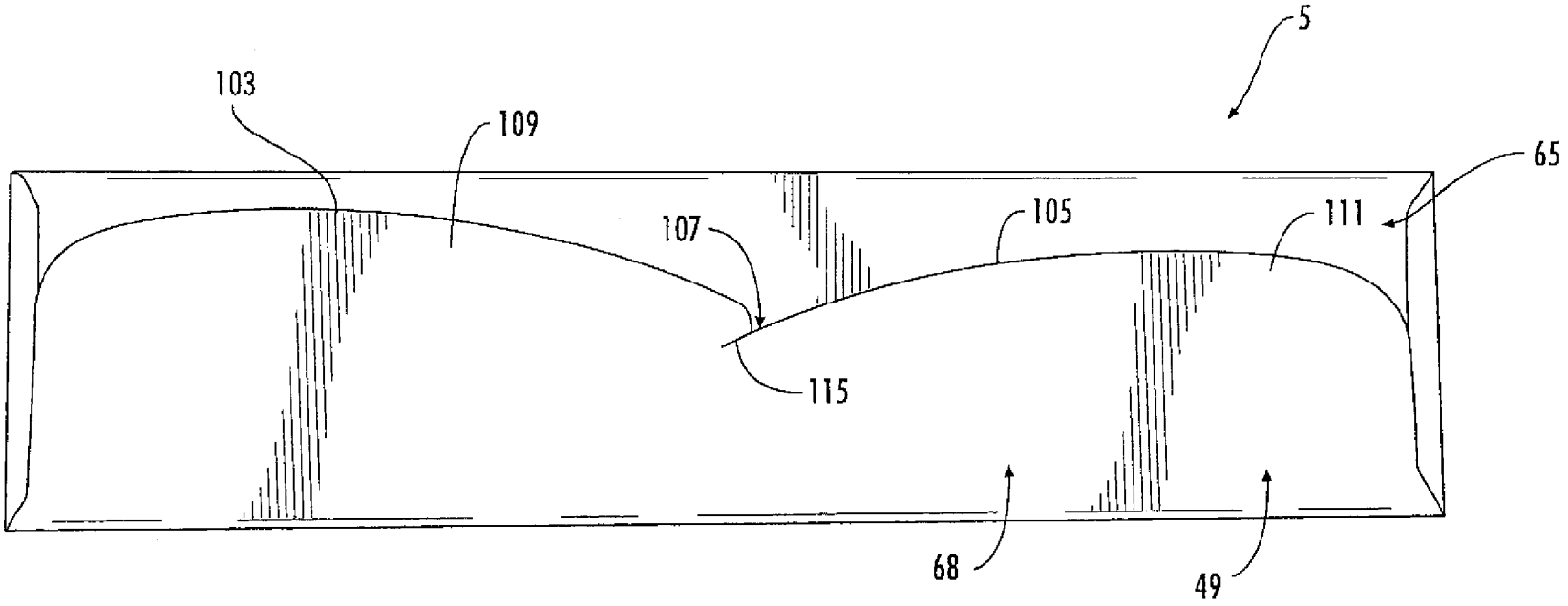
FIG. 3 is an end elevation view of the carton of the first embodiment.

As shown in FIGS. 2-7, and described in the following in accordance with one acceptable example, the carton 5 is formed from the blank 3 by folding panels 23, 25, 31, and 37 to at least partially form an interior 11 of the carton 5, for example, by creation of a sleeve. Attachment flap 41 may receive adhesive or glue and may be affixed to an interior surface of the first end panel 25. Upon formation of the sleeve, the ends 68, 69 of the carton 5 may be closed by inwardly folding and attaching end flaps 49, 55, 61, 65 and 51, 57, 63, 67, respectively. The end flaps 49, 55, 61, 65 and 51, 57, 63, 67 may be attached with glue in some embodiments. The carton 5 may be filled with products to be held therein during any suitable portion of carton formation, for example, through inclusion of a filled liner containing a food product. The filled liner may be adhered or affixed to an interior surface 9 of the carton 5 in some embodiments. After filling the carton 5 with product, both ends 68, 69 are closed as shown in FIGS. 2 and 3, and the carton is ready to be shipped to a point of sale location. In one embodiment, the end flap 49 is positioned to overlap the end flap 65 at the closed end 68, but the end flaps could be otherwise arranged without departing from the disclosure.

As shown in FIGS. 3 and 4, the closed end 68 of the carton 5 may be initially opened by sliding an object (e.g., a finger) beneath the end flap 49 to detach any adhesive holding the end closed and separating the first end flap and the second end flap 65. Thereafter, as shown in FIG. 3, the interior 11 of the carton 5 may be accessed such as when food product is withdrawn for consumption.

Figure 5:
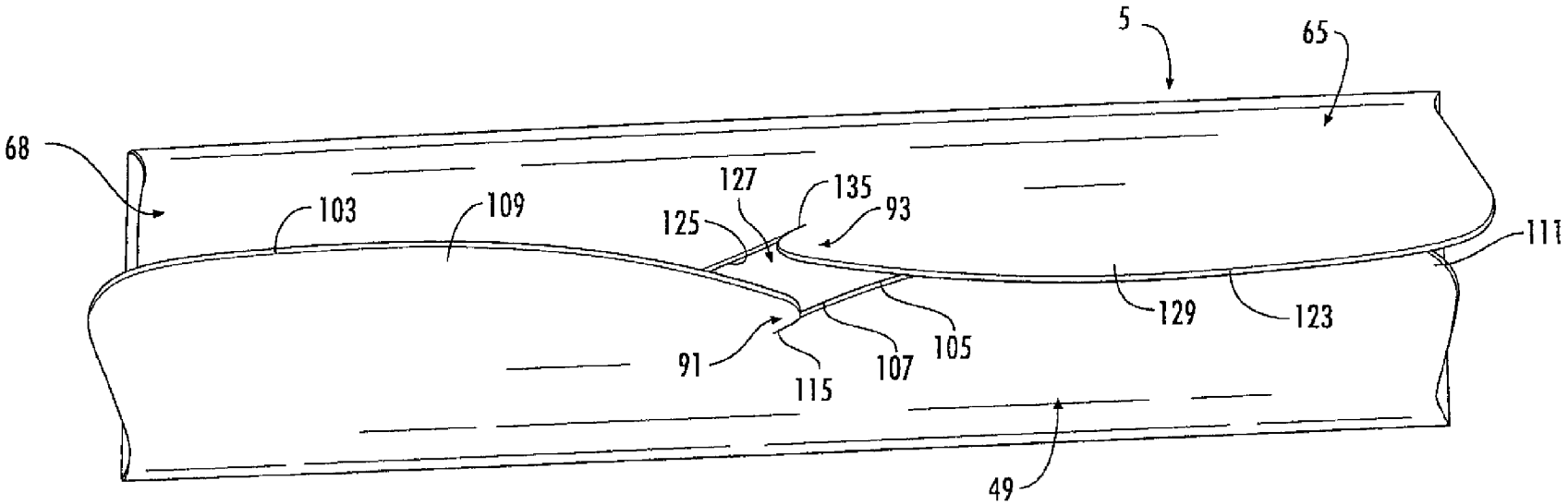
FIG. 5 is a view showing the end of the carton of FIG. 3 in a partially closed configuration.
Figure 6:
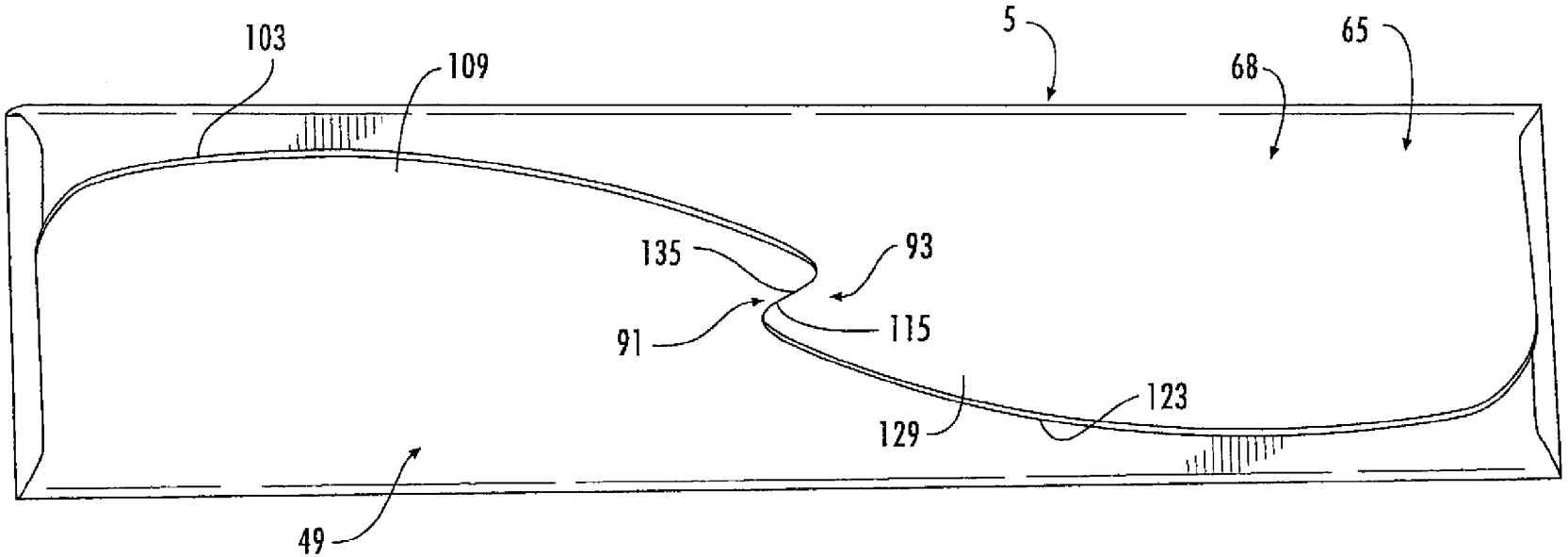
FIG. 6 is a view showing the end of the carton of FIG. 3 in a closed configuration.
Figure 7:
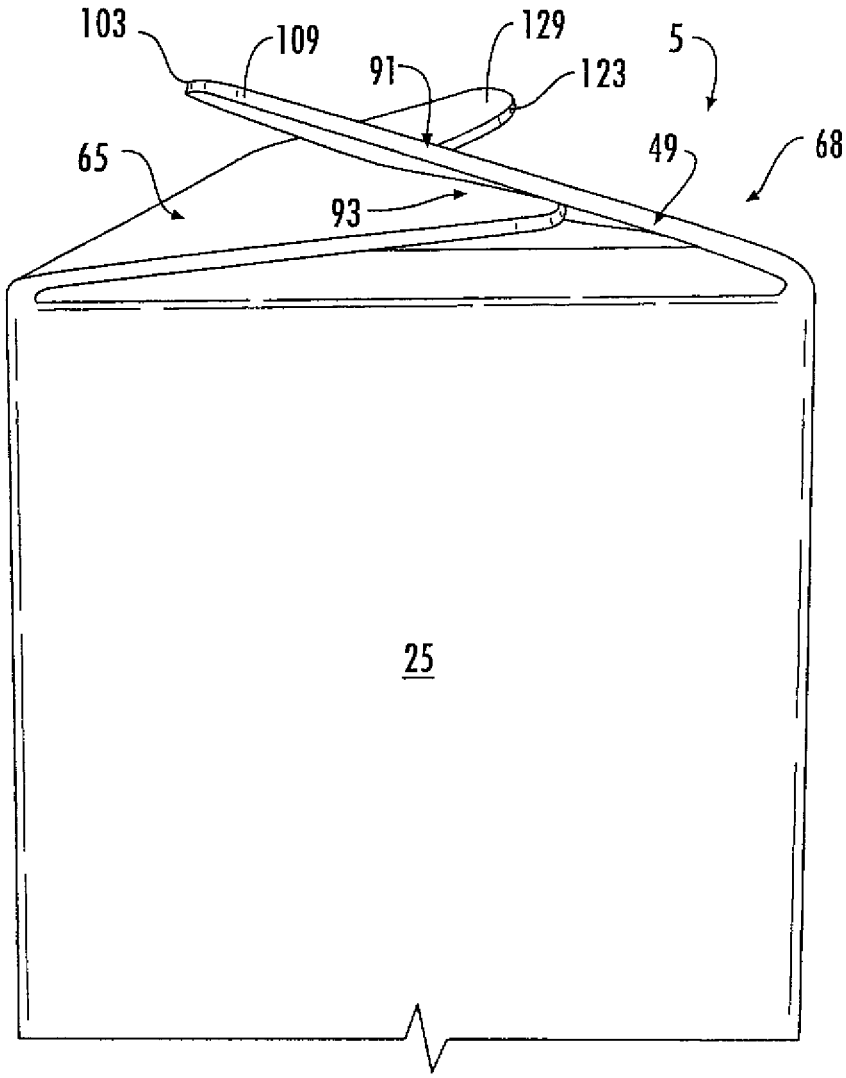
FIG. 7 is a side view showing the end of the carton of FIG. 3 in the partially closed configuration.

After removing the desired amount of material from the carton 5, the end 68 of the carton 5 can be closed by initiating the cooperating features 91, 93 of the first end flap 40 and the second end flap 65. The end flaps 49, 65 may be brought into contact with one another such that the first notch 107 and the second notch 127 are brought into registration to initiate locking of the end flaps. As shown in FIGS. 5 and 6, when the notches 107, 127 are in registration, the first flap portion 109 of the first end flap 49 overlaps the second flap portion 131 of the second end flap 65, and the first flap portion 129 of the second end flap overlaps the second flap portion 111 of the first end flap. In the closed and locked configuration, a portion of the first end flap portion 109 of the first end flap 49 is received in the cut 135 of the second end flap 65, and a portion of the first end flap portion 129 of the second end flap is received in the cut 115 of the first end flap to form an interlocking engagement of the end flaps. To disengage the end flaps 49, 65, an edge of either of the first end flap portions 109, 129 can be moved to withdraw the respective end flap portion from the respective cut 115, 135 and notch 107, 127 so the end flaps can be readily separated to access the interior 11 of the carton 5. The end flaps 49, 65, or features 91, 93 of the end flaps can be otherwise positioned, moved, manipulated, etc. to interlock the end flaps and to separate the end flaps without departing from the disclosure.

Alternative assembling, loading, closing, opening, re-closing, and/or re-opening steps may be used without departing from the scope of the disclosure. For example, the sleeve can be loaded and closed in an automated process, and the ends 68, 69 can be partially closed. Additionally, the carton 5 could be otherwise shaped, arranged, and/or configured without departing from the disclosure. The carton 5 could include various handle features for carrying the carton and could include various dispenser features for opening the carton or obtaining access to contents in the interior of the carton in manners not herein described. Further the carton 5 could include other panel/flap closing configurations without departing from the disclosure.

FIGS. 8-14 illustrate a blank 201 used to form a carton 205 of a second embodiment of the disclosure. The carton 205 is generally similar to the carton 5, in that the carton may include a liner, bag, or other construct that is in contact with an interior surface 209 of the carton and may be configured to hold a plurality of products as described above. The carton 205 can include various dispensing features and various opening/closing features without departing from the disclosure.

The blank 203 has a longitudinal axis L3 extending generally in the direction of the length of the blank and a lateral axis L3 extending generally in the direction of the width of the blank. The blank 203 includes a first side panel 223 foldably connected to a first end panel 225 at a lateral fold line 227, a second end panel 231 is foldably connected to the first side panel 223 at a lateral fold line 233, a second side panel 237 is foldably connected to the second end panel 231 at a lateral fold line 239, and an attachment flap 241 is foldably connected to the second side panel 237 at a lateral fold line 245. Alternatively, the attachment flap 241 could be foldably connected to the first end panel 225 without departing from the disclosure.

In the illustrated embodiment, two end flaps 249, 251 are foldably connected to opposite ends of the first side panel 223, two end flaps 255, 257 are foldably connected to opposite ends of the first end panel 225, two end flaps 261, 263 are foldably connected to opposite ends of the second end panel 331, and two end flaps 265, 267 are foldably connected to opposite ends of the second side panel 237. When the carton 205 is erected, the end flaps 249, 255, 261, 265 close a first (e.g., top) end 268 of the carton, and the end flaps 251, 257, 263, 267 close a second (e.g., bottom) end 269 of the carton. In accordance with an alternative embodiment of the present disclosure, different panel and flap arrangements can be used for closing the carton 205.

The end flaps 249, 255, 261, 265 of the first end 268 extend along a first marginal area of the blank 203, and are foldably connected at a first longitudinal fold line 271 that extends along the length of the blank. The end flaps 251, 257, 263, 267 of the second end 269 extend along a second marginal area of the blank 203, and are foldably connected at a second longitudinal fold line 275 that extends along the length of the blank. The longitudinal fold lines 271, 275 may be, for example, substantially straight, or offset at one or more locations to account for blank thickness or for other factors. The end flaps 249, 255, 265, 251, 257, 261, 263, 267 can be alternatively shaped, arranged, positioned, and/or omitted without departing from the disclosure.

Figure 8:
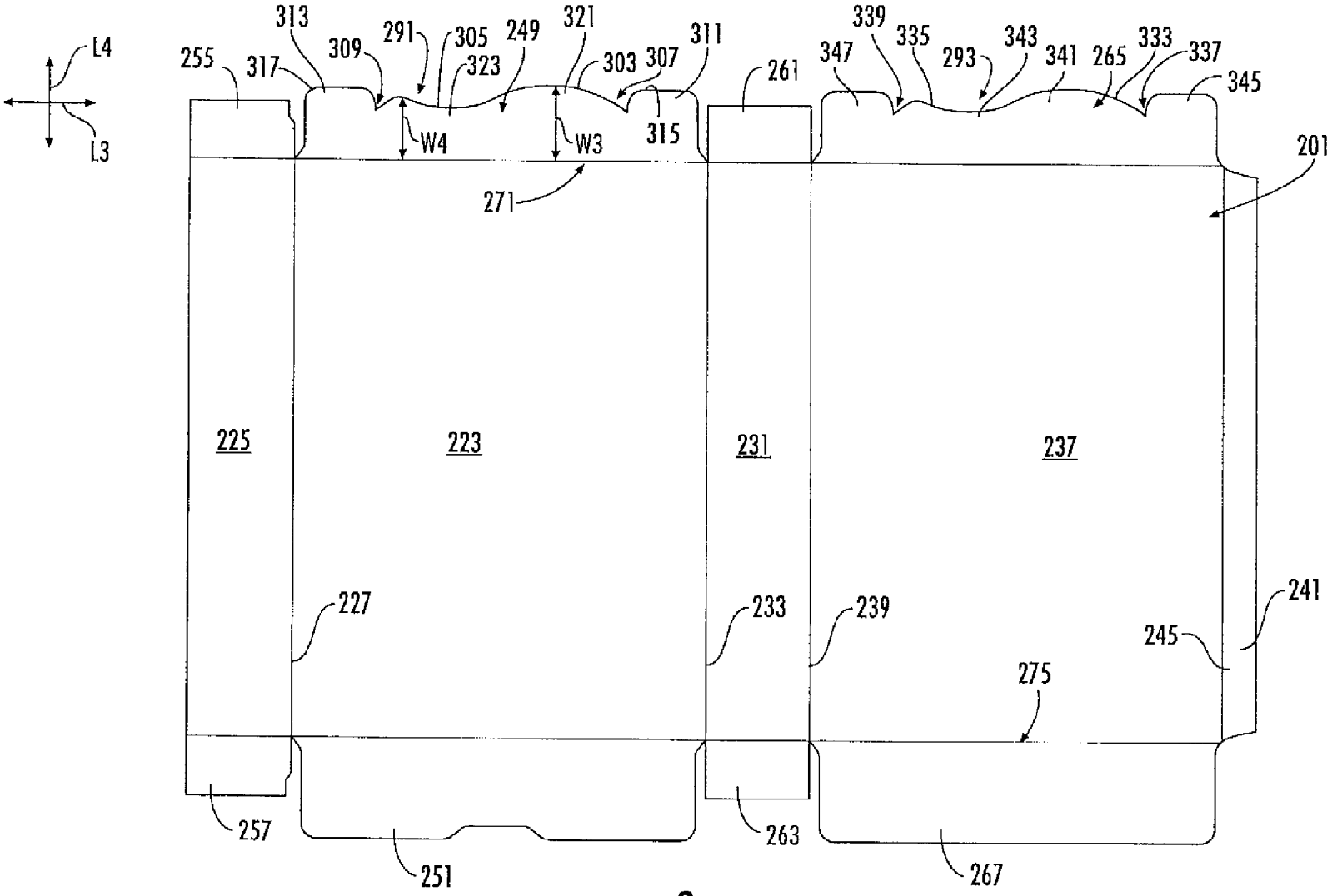
FIG. 8 is an exterior plan view of a blank used to form a carton in accordance with a second embodiment of the disclosure.

As shown in FIG. 8, the end flaps 249, 265 each have cooperating features 291, 293 that facilitate opening and closing the top end 268 of the carton 205. In one embodiment, the features 291 of the first end flap 249 include a first curved edge 303, a second curved edge 305 in a central portion of the end flap 249. The first curved edge 303 extends from a first notch 307 in the end flap 249 and the second curved edge 305 extends from a second notch 309 in the end flap. The first curved edge 303 and the second curved edge 305 converge at approximately the centerline of the end flap 249. In one embodiment, the first end flap 249 comprises a first end portion 311 adjacent the first notch 307 and a second end portion 313 adjacent the second notch 309. Each of the end portions 311, 313 comprises substantially straight edges 315, 317 of the end flap 249. In one embodiment, the first curved edge 303 comprises a first central flap portion 321, and the second curved edge 305 comprises a second central flap portion 323. In one embodiment, the first central flap portion 321 has a maximum width W3 measured from the fold line 271 that is greater than a maximum width W4 of the second central flap portion 323 measured from the fold line 271. The end flap 249 could be otherwise shaped, arranged, and/or configured without departing from the disclosure.

In the embodiment of FIG. 8, the second end flap 265 is shaped identical to first end flap 249 such that the cooperating features 293 of the second end flap are identical to the cooperating features 291 of the first end flap. The second end flap 265 has curved edges 333, 335, notches 337, 339, a first central flap portion 341, a second central flap portion 343, and end portions 345, 347 similar to the corresponding features of the first end flap 249. The second end flap 265 could be otherwise shaped, arranged, and/or configured without departing from the disclosure.

Figure 9:
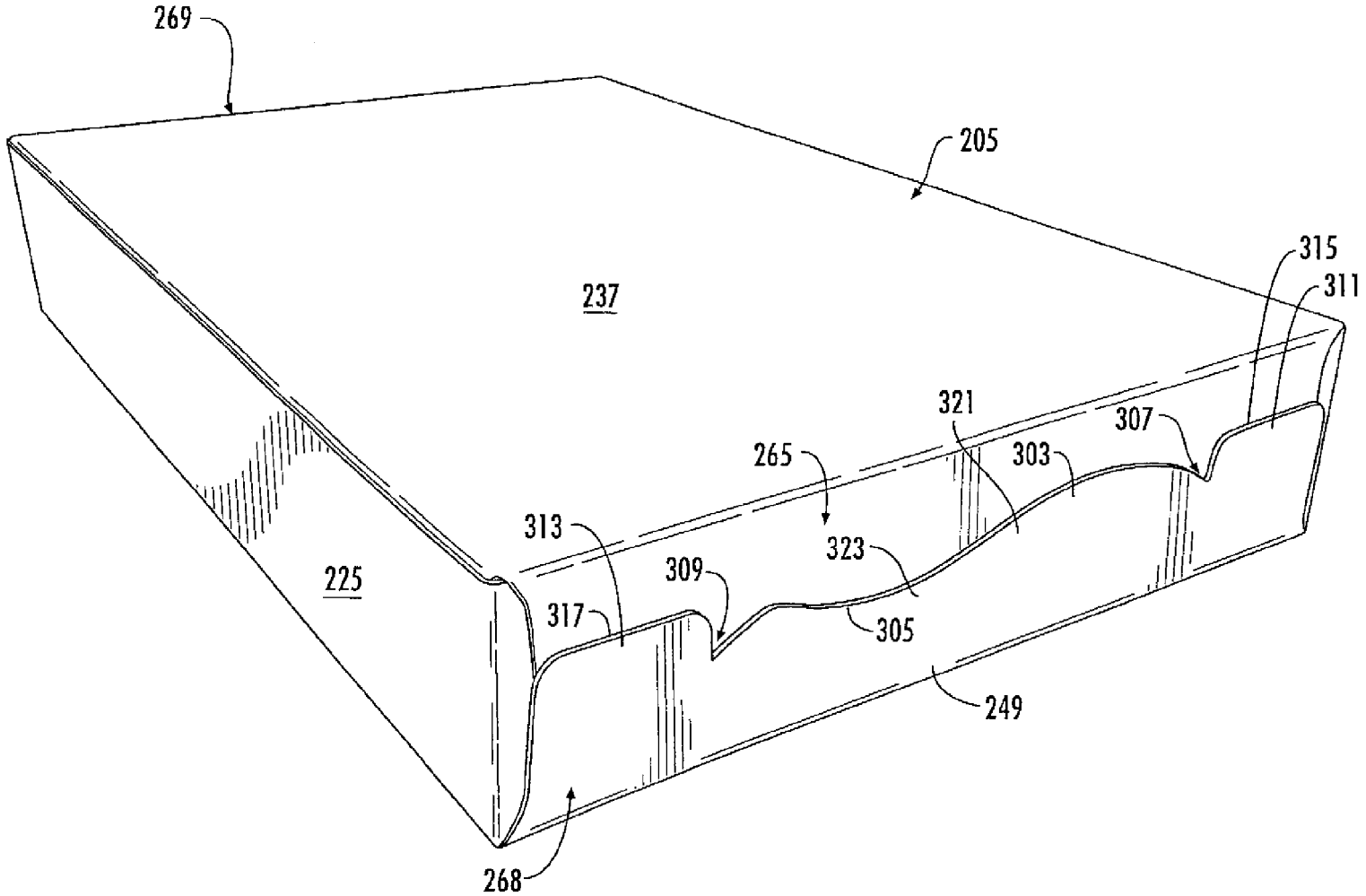
FIG. 9 is a perspective view of the carton of the first embodiment.
Figure 10:
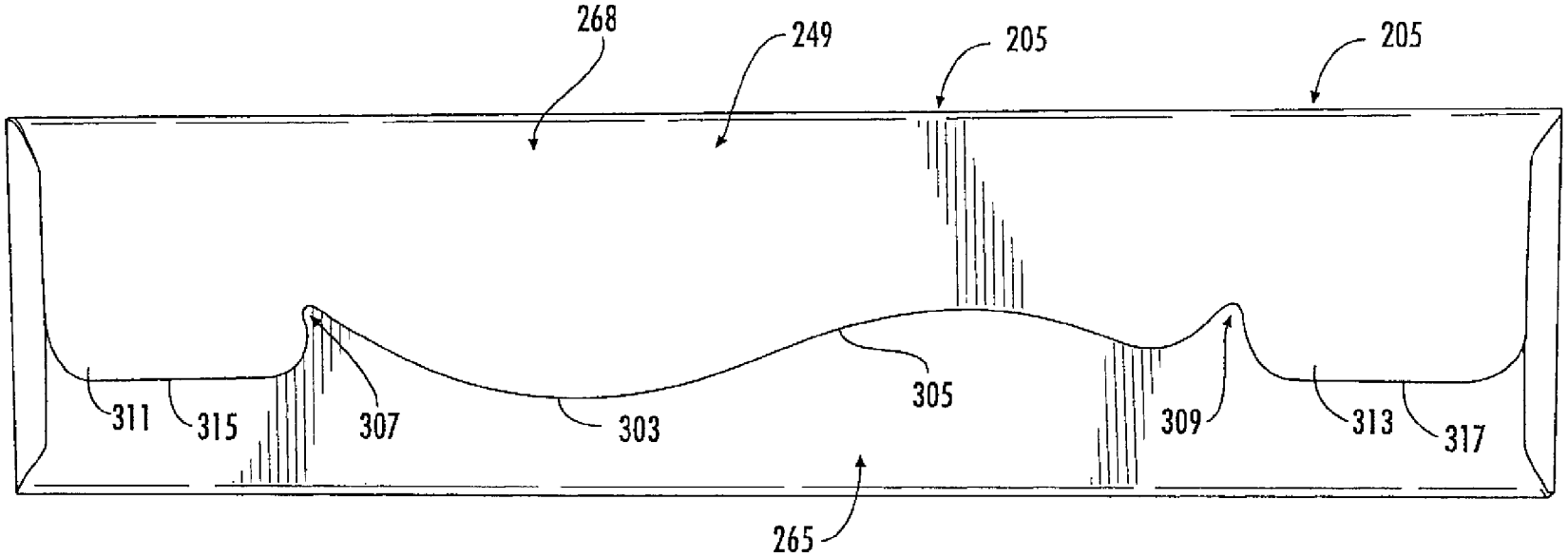
FIG. 10 is an end elevation view of the carton of the first embodiment.

As shown in FIGS. 9-14, and described in the following in accordance with one acceptable example, the carton 205 is formed from the blank 203 in a similar manner as the carton 5 of the first embodiment. The panels 223, 225, 231, and 237 are folded to at least partially form an interior space 211 of the carton 205, for example, by creation of a sleeve. Attachment flap 241 may receive adhesive or glue and may be affixed to an interior surface of the first end panel 25. Upon formation of the sleeve, the ends 268, 269 of the carton 205 may be closed by inwardly folding and attaching end flaps 249, 255, 261, 265 and 251, 257, 263, 267, respectively. The end flaps 249, 255, 261, 265 and 251, 257, 263, 267 may be attached with glue in some embodiments. The carton may be filled with products to be held therein during any suitable portion of carton formation, for example, through inclusion of a filled liner containing a food product. The filled liner may be adhered or affixed to an interior surface 209 of the carton 205 in some embodiments. After filling the carton 205 with product, both ends 268, 269 are closed as shown in FIGS. 9 and 10, and the carton is ready to be shipped to a point of sale location. In one embodiment, the end flap 249 is positioned to overlap the end flap 265 at the closed end 268, but the end flaps could be otherwise arranged without departing from the disclosure.

Figure 11:
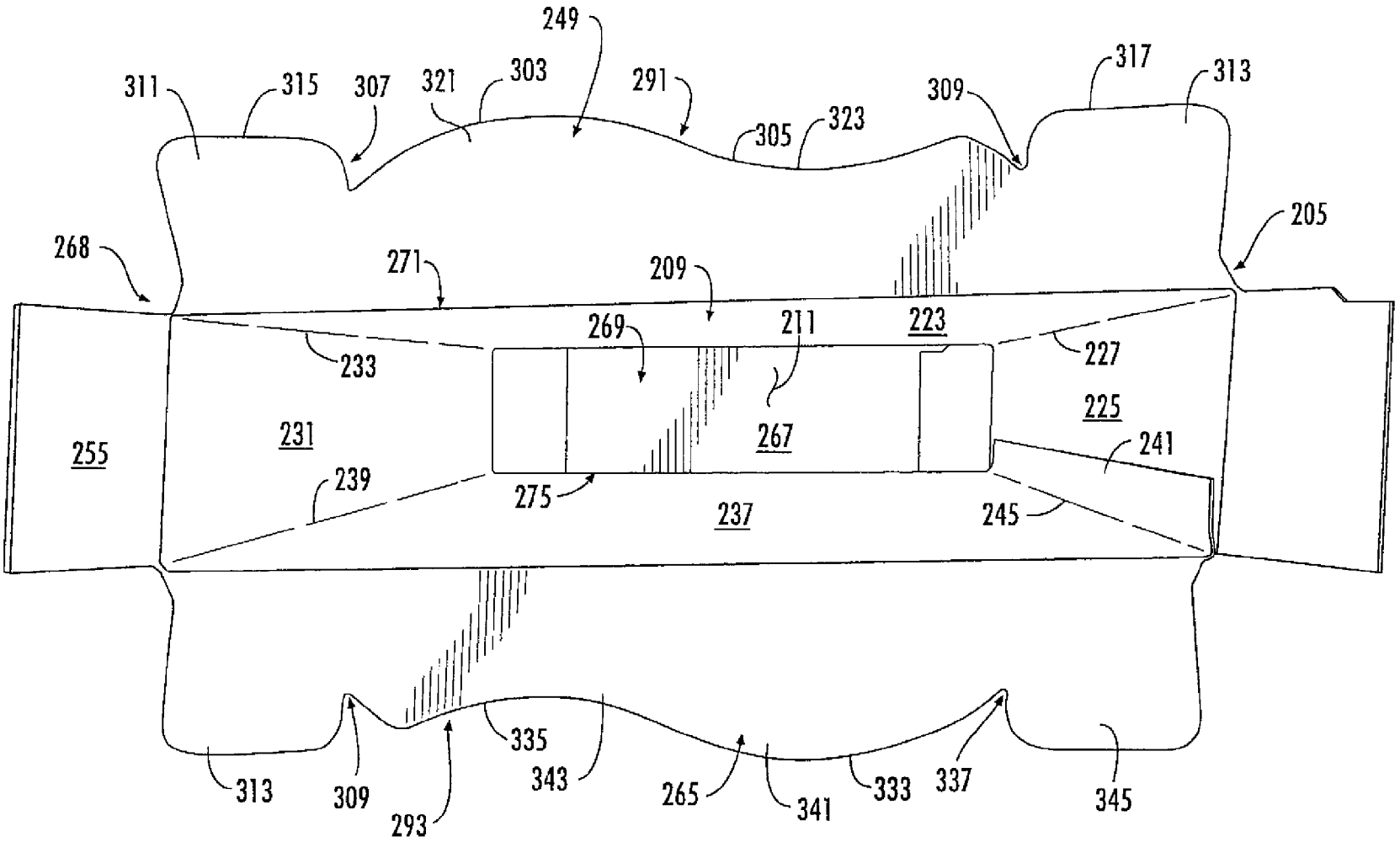
FIG. 11 is a view showing the end of the carton of FIG. 10 in an opened configuration.
Figure 12:
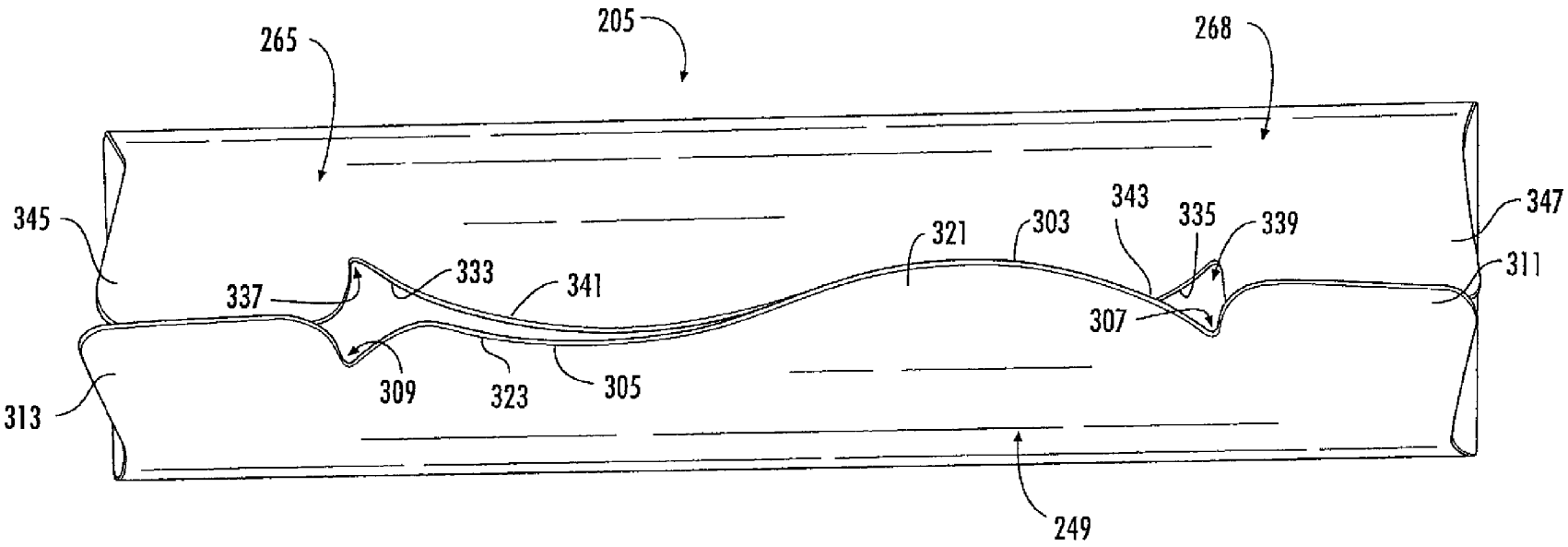
FIG. 12 is a view showing the end of the carton of FIG. 10 in a partially closed configuration.

As shown in FIGS. 9 and 10, the closed end 268 of the carton 205 may be initially opened by sliding an object (e.g., a finger) beneath the end flap 249 to detach any adhesive holding the end closed and separating the first end flap and the second end flap 265. Thereafter, as shown in FIG. 11, the interior 211 of the carton 205 may be accessed such as when food product is withdrawn for consumption.

Figure 13:
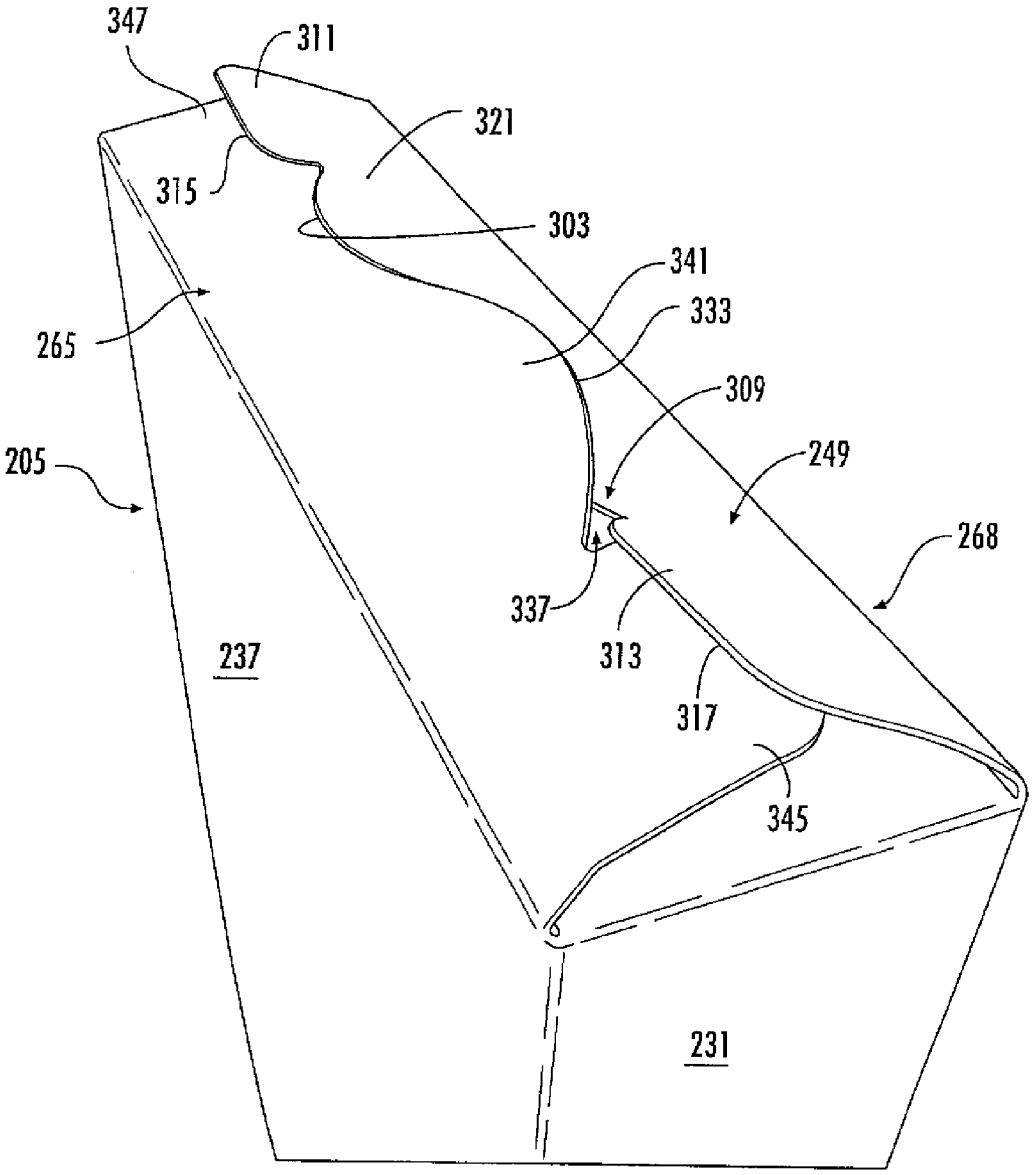
FIG. 13 is a view showing the end of the carton of FIG. 10 in the partially closed configuration.
Figure 14:
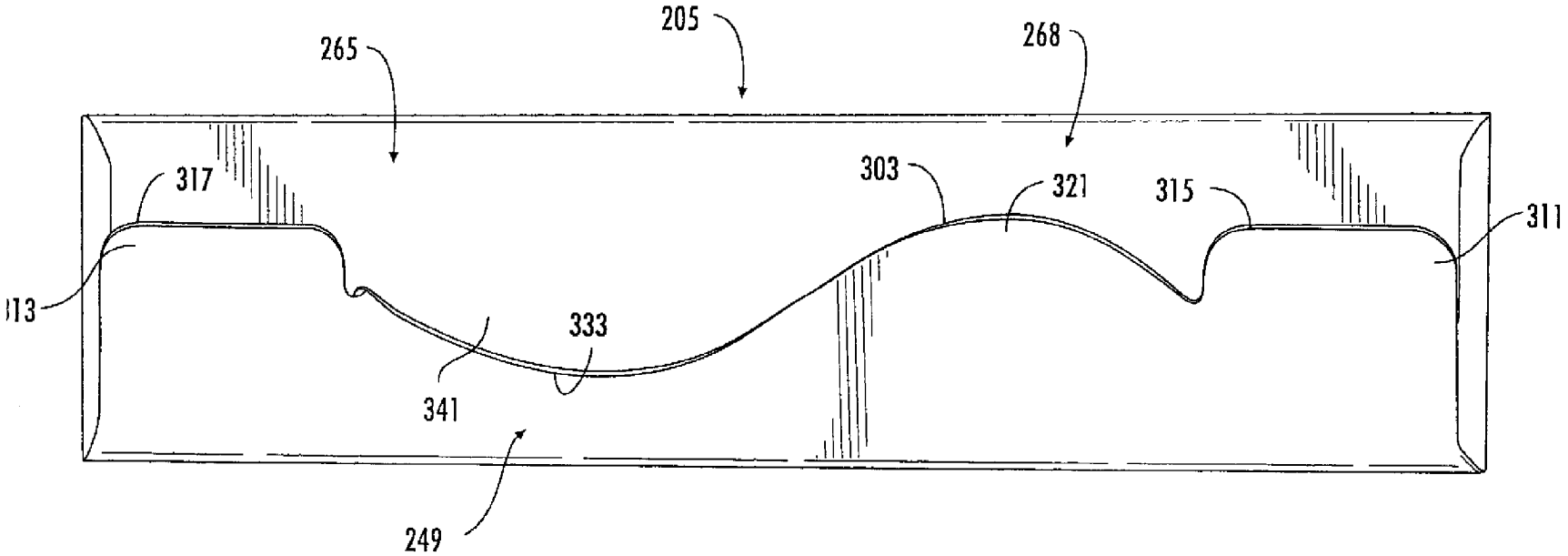
FIG. 14 is a side view showing the end of the carton of FIG. 10 in the partially closed configuration.

After removing the desired amount of material from the carton 205, the end 268 of the carton 205 can be closed by initiating the cooperating features 291, 293 of the first end flap 249 and the second end flap 265. The flaps 249, 265 may be brought into contact with one another such that the first notch 307 in the first end flap 249 and the second notch 339 in the second end flap are brought into registration to initiate locking of the end flaps. At the same time, the first notch 337 of the second end flap 265 is brought into registration with the second notch 309 of the first end flap 249 to further lock the end flaps in an interlocking engagement. As shown in FIGS. 13 and 14 in the interlocking engagement of the end flaps 249, 265 in the closed position, when the notches 307, 309, 337, 339 are in registration, the first central flap portion 321 of the first end flap 249 overlaps the second central flap portion 343 of the second end flap 265, and the first central flap portion 341 of the second end flap overlaps the second central flap portion 323 of the first end flap. In one embodiment, the end portions 311, 313 of the first end flap 349 overlap the respective end portions 345, 347 of the second end flap 365, but the end portions could be otherwise arranged (e.g., one of the end portions of the second end flap could overlap one of the end portions of the first end flap, or both of the end portions of the second end flap could overlap respective end portions of the first end flap) without departing from the disclosure. To disengage the end flaps 249, 265, an edge of either of the first central end flap portions 321, 341 can be moved to withdraw the respective end flaps from the notches 307, 309, 337, 339 so the end flaps can be readily separated to access the interior 11 of the carton 5. Also, the end portions 311, 313, can be grasped to separate the end flaps 249, 265. Further, other features or portions of the features 291, 293 of the end flaps can be otherwise positioned, moved, manipulated, etc. to interlock the end flaps and to separate the end flaps without departing from the disclosure.

Alternative assembling, loading, closing, opening, re-closing, and/or re-opening steps may be used without departing from the scope of the disclosure. For example, the sleeve can be loaded and closed in an automated process, and the ends 68, 69 can be partially closed. Additionally, the carton 5 could be otherwise shaped, arranged, and/or configured without departing from the disclosure. The carton 5 could include various handle features for carrying the carton and could include various dispenser features for opening the carton or obtaining access to contents in the interior of the carton in manners not herein described. Further the carton 5 could include other panel/flap closing configurations without departing from the disclosure.

The cartons 5, 205 are shown and described by way of example. Any of the features of the various embodiments of the disclosure can be combined with, replaced by, or otherwise configured with other features of other embodiments of the disclosure without departing from the scope of this disclosure.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, kraft lined paperboard, double kraft lined paperboard, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for containing a product, the carton comprising:

a plurality of panels that extends at least partially around an interior of the carton, the plurality of panels comprises a first end panel, a first side panel, a second end panel, and a second side panel;

a plurality of end flaps respectively foldably connected to a respective panel of the plurality of panels for closing an end of the carton, the plurality of end flaps comprises a first end flap foldably connected to the first side panel and a second end flap foldably connected to second side panel, each of the first end flap and the second end flap comprising a first curved edge and a second curved edge, the first end flap and the second end flap have cooperating features for interlocking engagement of the end flaps in a closed configuration of the carton, the cooperating features comprising a first notch in the first end flap and a second notch in the second end flap, the first notch and the second notch are for being in registration for locking the first end flap and the second end flap in a closed configuration, and each of the first notch and the second notch is formed at the convergence of the respective first curved edge and second curved edge of a respective first end flap and second end flap.

2. The carton of claim 1, wherein each of the first end flap and the second end flap comprises a first flap portion and second flap portion, the first flap portion comprising the first curved edge and the second flap portion comprising the second curved edge.

3. The carton of claim 2, wherein the first flap portion of the first end flap overlaps the second flap portion of the second end flap in the closed configuration and the first flap portion of the second end flap overlaps the second flap portion of the first end flap in the closed configuration.

4. A carton for containing a product, the carton comprising:

a plurality of panels that extends at least partially around an interior of the carton, the plurality of panels comprises a first end panel, a first side panel, a second end panel, and a second side panel;

a plurality of end flaps respectively foldably connected to a respective panel of the plurality of panels for closing an end of the carton, the plurality of end flaps comprises a first end flap foldably connected to the first side panel and a second end flap foldably connected to second side panel, each of the first end flap and the second end flap comprising a first curved edge and a second curved edge, the first end flap and the second end flap have cooperating features for interlocking engagement of the end flaps in a closed configuration of the carton; and wherein the each of the first end flap and the second end flap comprises a cut extending from an intersection of the first curved edge and the second curved edge.

5. The carton of claim 1, wherein the cooperating features comprises a third notch in the first end flap and a fourth notch in the second end flap, the third notch and the fourth notch are for being in registration for locking the first end flap and the second end flap in a closed configuration.

6. A carton for containing a product, the carton comprising:

a plurality of panels that extends at least partially around an interior of the carton the plurality of panels comprises a first end panel, a first side panel, a second end panel, and a second side panel;

a plurality of end flaps respectively foldably connected to a respective panel of the plurality of panels for closing an end of the carton the plurality of end flaps comprises a first end flap foldably connected to the first side panel and a second end flap foldably connected to second side panel, each of the first end flap and the second end flap comprising a first curved edge and a second curved edge, the first end flap and the second end flap have cooperating features for interlocking engagement of the end flaps in a closed configuration of the carton, the cooperating features comprising a first notch in the first end flap and a second notch in the second end flap, the first notch and the second notch are for being in registration for locking the first end flap and the second end flap in a closed configuration, and a third notch in the first end flap and a fourth notch in the second end flap, the third notch and the fourth notch are for being in registration for locking the first end flap and the second end flap in a closed configuration; and wherein the first end flap comprises a first curved edge extending between the first notch and the second notch, and the second end flap comprises a second curved edge extending between the second notch and the fourth notch.

7. The carton of claim 6, wherein the first end flap comprises a first end portion adjacent the first notch and a second end portion adjacent the third notch, and the second end flap comprises a third end portion adjacent the second notch and a fourth end portion adjacent the fourth notch.

8. The carton of claim 7, wherein the first end portion overlaps the third end portion and the second end portion overlaps the fourth end portion in the closed configuration.

9. The carton of claim 7, wherein each of the first end portion, the second end portion, the third end portion, and the fourth end portion comprises a respective straight edge.

10. A blank for forming a carton for containing a product, the blank comprising:

a plurality of panels comprising a first end panel, a first side panel, a second end panel, and a second side panel;

a plurality of end flaps respectively foldably connected to a respective panel of the plurality of panels for closing an end of the carton formed from the blank, the plurality of end flaps comprises a first end flap foldably connected to the first side panel and a second end flap foldably connected to second side panel, each of the first end flap and the second end flap comprising a first curved edge and a second curved edge, the first end flap and the second end flap have cooperating features for interlocking engagement of the end flaps in a closed configuration of the carton formed from the blank, the cooperating features comprising a first notch in the first end flap and a second notch in the second end flap, the first notch and the second notch are for being in registration for locking the first end flap and the second end flap in a closed configuration of the carton formed from the blank, and each of the first notch and the second notch is formed at the convergence of the respective first curved edge and second curved edge of a respective first end flap and second end flap.

11. The blank of claim 10, wherein each of the first end flap and the second end flap comprises a first flap portion and second flap portion, the first flap portion comprising the first curved edge and the second flap portion comprising the second curved edge.

12. A blank for forming a carton for containing a product, the blank comprising:

a plurality of panels comprising a first end panel, a first side panel, a second end panel, and a second side panel;

a plurality of end flaps respectively foldably connected to a respective panel of the plurality of panels for closing an end of the carton formed from the blank, the plurality of end flaps comprises a first end flap foldably connected to the first side panel and a second end flap foldably connected to second side panel, each of the first end flap and the second end flap comprising a first curved edge and a second curved edge, the first end flap and the second end flap have cooperating features for interlocking engagement of the end flaps in a closed configuration of the carton formed from the blank, the cooperating features comprising a first notch in the first end flap and a second notch in the second end flap, the first notch and the second notch are for being in registration for locking the first end flap and the second end flap in a closed configuration of the carton formed from the blank; and wherein the each of the first end flap and the second end flap comprises a cut extending from an intersection of the first curved edge and the second curved edge.

13. The blank of claim 10, wherein the cooperating features comprises a third notch in the first end flap and a fourth notch in the second end flap, the third notch and the fourth notch are for being in registration for locking the first end flap and the second end flap in a closed configuration.

14. A blank for forming a carton for containing a product, the blank comprising:

a plurality of panels comprising a first end panel, a first side panel, a second end panel, and a second side panel;

a plurality of end flaps respectively foldably connected to a respective panel of the plurality of panels for closing an end of the carton formed from the blank, the plurality of end flaps comprises a first end flap foldably connected to the first side panel and a second end flap foldably connected to second side panel, the first end flap and the second end flap have cooperating features for interlocking engagement of the end flaps in a closed configuration of the carton formed from the blank, the cooperating features comprising a first notch in the first end flap and a second notch in the second end flap, the first notch and the second notch are for being in registration for locking the first end flap and the second end flap in a closed configuration of the carton formed from the blank, the cooperating features comprises a third notch in the first end flap and a fourth notch in the second end flap, the third notch and the fourth notch are for being in registration for locking the first end flap and the second end flap in a closed configuration; and wherein the first end flap comprises a first curved edge extending between the first notch and the second notch, and the second end flap comprises a second curved edge extending between the second notch and the fourth notch.

15. The blank of claim 14, wherein the first end flap comprises a first end portion adjacent the first notch and a second end portion adjacent the third notch, and the second end flap comprises a third end portion adjacent the second notch and a fourth end portion adjacent the fourth notch.

16. The blank of claim 15, wherein each of the first end portion, the second end portion, the third end portion, and the fourth end portion comprises a respective straight edge.

17. A method of forming a carton, the method comprising:

obtaining a blank comprising a plurality of panels comprising a first end panel, a first side panel, a second end panel, and a second side panel, a plurality of end flaps respectively foldably connected to a respective panel of the plurality of panels, the plurality of end flaps comprises a first end flap foldably connected to the first side panel and a second end flap foldably connected to second side panel, each of the first end flap and the second end flap comprising a first curved edge and a second curved edge, and each of the first notch and the second notch is formed at the convergence of the respective first curved edge and second curved edge of a respective first end flap and second end flap, the first end flap and the second end flap have cooperating features for opening and closing the end of the carton formed from the blank, the cooperating features comprising a first notch in the first end flap and a second notch in the second end flap;

forming an interior of the carton at least partially defined by the plurality of panels;

positioning the plurality of end flaps to close an end of the interior wherein the first end flap and the second end flap are at least partially overlapped and are secured;

opening the end of the carton by separating the first end flap and the second end flap;

closing the end of the carton by interlockingly engaging the cooperating features of the first end flap and the second end flap by moving the first notch and the second notch into registration and locking the first end flap and the second end flap in the a closed configuration.

18. The method of claim 17, wherein each of the first end flap and the second end flap comprises a first flap portion and second flap portion, the first flap portion comprising the first curved edge and the second flap portion comprising the second curved edge, and the closing the end of the carton comprises overlapping the first flap portion of the first end flap and the second flap portion of the second end flap and overlapping the first flap portion of the second end flap and the second flap portion of the first end flap.

19. The method of claim 17, wherein the each of the first end flap and the second end flap comprises a cut extending from an intersection of the first curved edge and the second curved edge, the closing the end comprises engaging a respective portion of each of the first end flap and the second end flap in a respective cut.

20. The method of claim 17, wherein the cooperating features comprises a third notch in the first end flap and a fourth notch in the second end flap, the closing the end of the carton comprises moving the third notch and the fourth notch into registration.

21. The method of claim 20, wherein the first end flap comprises a first curved edge and a second curved edge between the first notch and the second notch, the second end flap comprises a third curved edge and a fourth curved edge between the second notch and the fourth notch, the first end flap comprises a first end portion adjacent the first notch and a second end portion adjacent the third notch, and the second end flap comprises a third end portion adjacent the second notch and a fourth end portion adjacent the fourth notch, the closing the end comprises overlapping the first end portion and the third end portion and overlapping the second end portion and the fourth end portion.

* * * * *